US006493897B2

(12) United States Patent
Culbreth

(10) Patent No.: US 6,493,897 B2
(45) Date of Patent: Dec. 17, 2002

(54) ORTHODONTIC TOOTHBRUSH

(76) Inventor: Fay H. Culbreth, 4304 Park Rd., Charlotte, NC (US) 28209

( * ) Notice: Subject to any disclaimer, the term of this patent is extended or adjusted under 35 U.S.C. 154(b) by 0 days.

(21) Appl. No.: 10/102,372

(22) Filed: Mar. 20, 2002

(65) Prior Publication Data

US 2002/0108199 A1 Aug. 15, 2002

Related U.S. Application Data

(63) Continuation of application No. 09/711,434, filed on Nov. 13, 2000.

(51) Int. Cl.[7] ..... A46B 9/04
(52) U.S. Cl. ..... 15/167.1; D4/104
(58) Field of Search ..... 15/143.1, 167.1, 15/167.2, 171; D4/104, 105, 110

(56) References Cited

U.S. PATENT DOCUMENTS

| | | | | |
|---|---|---|---|---|
| 43,597 | A | | 7/1864 | Nelson |
| 54,604 | A | * | 5/1866 | Rosefield |
| 1,507,500 | A | * | 9/1924 | Metz |
| 1,647,453 | A | | 11/1927 | Krantz |
| 1,680,558 | A | | 8/1928 | Loiselle |
| 2,047,613 | A | | 7/1936 | Brown |
| 2,292,707 | A | * | 8/1942 | Mantell |
| 2,503,134 | A | | 4/1950 | Schroeder |
| 3,100,309 | A | | 8/1963 | Gambino |
| 3,474,481 | A | | 10/1969 | Soleymani et al. |
| 3,590,414 | A | * | 7/1971 | Gores |
| 4,010,509 | A | | 3/1977 | Huish |
| 4,020,521 | A | | 5/1977 | Velasquez |
| D248,696 | S | | 8/1978 | Greenberg |
| 4,403,623 | A | | 9/1983 | Mark |
| D274,018 | S | | 5/1984 | Usui |
| 4,610,045 | A | * | 9/1986 | Rauch |
| 4,757,570 | A | * | 7/1988 | Haeusser et al. |
| D342,162 | S | * | 12/1993 | Curtis et al. |
| 5,315,730 | A | | 5/1994 | Kim et al. |
| D353,939 | S | * | 1/1995 | Curtis et al. |
| 5,564,150 | A | | 10/1996 | Ciccotelli |
| 5,570,487 | A | | 11/1996 | Schneider |
| D395,363 | S | * | 6/1998 | Moscovich |
| 5,774,922 | A | * | 7/1998 | Bumb |
| 5,953,783 | A | * | 9/1999 | Hahn |
| 6,086,373 | A | | 7/2000 | Schiff et al. |
| 6,094,768 | A | | 8/2000 | Hugon et al. |
| 6,112,361 | A | | 9/2000 | Brice |
| 6,230,355 | B1 | * | 5/2001 | Harada |
| 6,345,406 | B1 | * | 2/2002 | Dodd |
| RE37,625 | E | * | 4/2002 | Wieder et al. |

* cited by examiner

*Primary Examiner*—Terrence R. Till
(74) *Attorney, Agent, or Firm*—Adams, Schwartz & Evans, P.A.

(57) ABSTRACT

A toothbrush for cleansing the teeth, including a unitary body having a handle with a grip portion having concave indentations formed on a surface thereof, and a neck portion formed with the grip portion and positioned at an obtuse angle thereto. A cross-shaped head is formed with one end of the neck portion and includes a first head member positioned in axial alignment with the longitudinal axis of the handle. A second head member is formed with the first, and has a longitudinal axis positioned perpendicular to the longitudinal axis thereof. Each of the head members includes a preselected transaxial width, and rounded corners defined by respective curves having combined radii of at least seventy-five percent of the transaxial width of the head member. A multiplicity of bristles are attached to both head members and define an enlarged cleaning surface area sufficient to simultaneously engage the upper and lower teeth during brushing.

11 Claims, 8 Drawing Sheets

ORTHODONTIC TOOTHBRUSH

Continuation of prior application Ser. No. 09/711,434, filed Nov. 13, 2000.

TECHNICAL FIELD AND BACKGROUND OF THE INVENTION

This invention relates to a toothbrush for cleansing not only the surfaces of the teeth, but also any orthodontic appliances that are positioned thereon. In particular, the application discloses a toothbrush having an enlarged head and bristle surface with a unique shape that is specifically intended to allow a user to easily and thoroughly cleanse all of the surfaces of the upper and lower teeth, while simultaneously massaging and cleansing the gum line.

Effectively cleansing the teeth can be a difficult undertaking, particularly for those individuals who are undergoing orthodontic treatment. An individual who wears orthodontic appliances must not only strive to brush and floss the teeth, but is also faced with the added challenge of cleaning the additional wire, plastic or other orthodontic appliances which have been affixed to the surfaces of the teeth. Many prior art toothbrushes are not adequately shaped to allow users to quickly and effectively accomplish this task. For example, many conventional "I-shaped" toothbrushes, which have a narrow, rectangularly-shaped brush head, do not have a head or bristle surface having a surface area or shape that is large enough to allow an individual to easily and thoroughly brush the upper and lower teeth and gum line simultaneously. Over time, such inadequate brushing can lead not only to bacteria growth, but also to tartar and plaque buildup, which may ultimately cause a number of conditions, including but not limited to gingivitis and tooth decay.

The invention of the present application addresses these and other problems present in prior art toothbrushes by providing a toothbrush having a unique head and bristle structure. The invention provides a toothbrush having a handle to which a head is attached that has a least one bristle surface and corresponding head segment having longitudinal axes which are in alignment with the handle. At least one bristle surface and corresponding head segment has a longitudinal axis positioned either perpendicular to, or at an angle from, the handle. This configuration results in a toothbrush having an enlarged head and corresponding bristle surface area having a unique shape which allows the user to easily approach and thoroughly brush the lingual and buccal surfaces of the teeth. Although the toothbrush is designed with orthodontic patients in mind, it is also suitable for use by individuals who do not wear orthodontic appliances, but wish to cleanse their teeth in a faster, more efficient manner.

SUMMARY OF THE INVENTION

It is therefore an object of the invention to provide a toothbrush for use by orthodontic or dental patients which has an increased bristle surface area and corresponding head shape for permitting quicker and more effective cleansing of the teeth.

It is another object of the present invention to provide a toothbrush that effectively removes food particles and other detritus while stimulating the gums for better health.

It is another object of the invention to provide a toothbrush that includes a brush head with at least one head segment and corresponding bristle surface shaped to permit a user to simultaneously brush the upper and lower surfaces of the teeth while simultaneously massaging the gum line.

These and other objects of the present invention are achieved in the preferred embodiments disclosed below by providing a toothbrush for cleansing the surfaces of the teeth and any orthodontic appliances positioned thereon. The toothbrush includes a unitary body and an elongate handle having a grip portion with concave indentations formed on a surface thereof for permitting a user to grasp the handle. A neck portion is integrally formed with the grip portion and is positioned at an obtuse angle thereto. A cross-shaped head is integrally formed with one end of the neck portion and includes a first head member positioned in axial alignment with the longitudinal axis of the handle. A second head member is integrally formed with the first head member and has a longitudinal axis positioned perpendicular to the longitudinal axis thereof. Each of the head members includes a preselected transaxial width, and rounded corners defined by respective curves having combined radii of at least seventy-five percent of the transaxial width of the head member for permitting ease of movement of the head member past the irregularities of the user's mouth and the outwardly-extending orthodontic appliances. A multiplicity of upright bristles are attached to both head members and extend outwardly therefrom for defining an enlarged cleaning surface area sufficient to simultaneously engage the upper and lower teeth during brushing.

According to one preferred embodiment of the invention, the neck and grip portions each include a preselected width transaxial to the longitudinal axis of the handle, and the transaxial width of the neck portion is less than the transaxial width of the grip portion.

According to another preferred embodiment of the invention, the first and second head members define at least three distinct and diverging head segments. Two of the head segments are positioned opposite each other and extend along a common axis, and another of the head segments is positioned perpendicular thereto.

According to yet another preferred embodiment of the invention, the first and second head members define four head segments. Two of the head segments are positioned opposite each other and extend along a common axis, and the other two head segments are positioned perpendicular thereto.

According to yet another preferred embodiment of the invention, the first and second head members are positioned perpendicular to each other and are carried by the handle at point at which any two of the head segments diverge.

According to yet another preferred embodiment of the invention, the first and second head members collectively define a first planar face to which the bristles are attached.

According to yet another preferred embodiment of the invention, the bristles are grouped to form a multiplicity of tufts positioned in spaced-apart relation to one another and staked to the head segments.

According to yet another preferred embodiment of the invention, the first and second head members collectively define a first planar face to which the tufts are attached.

According to yet another preferred embodiment of the invention, the first and second head members collectively define a second planar face positioned in spaced-apart, opposing relation to the first planar face and interconnected therewith by a sidewall, thereby forming the cross-shaped head.

According to yet another preferred embodiment of the invention, the head is positioned at an obtuse angle to the neck portion.

According to yet another preferred embodiment of the invention, another toothbrush for cleansing the surfaces of the teeth and any orthodontic appliances positioned thereon is provided. The toothbrush includes an elongate handle. A head is carried on one end of the handle and includes first and second intersecting head members carrying cleaning elements thereon. The head members define at least three distinct and diverging head segments for providing an enlarged cleaning surface area sufficient to simultaneously engage the upper and lower teeth during brushing. The first and second head members are positioned perpendicular to each other and are carried by the handle at a point at which any two of the head segments diverge.

According to yet another preferred embodiment of the invention, the head and the handle are integrally formed with each other.

According to yet another preferred embodiment of the invention, the first and second head members are integrally formed with each other.

According to yet another preferred embodiment of the invention, first and second head members are integrally formed with the handle.

According to yet another preferred embodiment of the invention, at least one head segment is in longitudinal alignment with a longitudinal axis of the handle.

According to yet another preferred embodiment of the invention, the cleaning elements are made of coarse felt.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
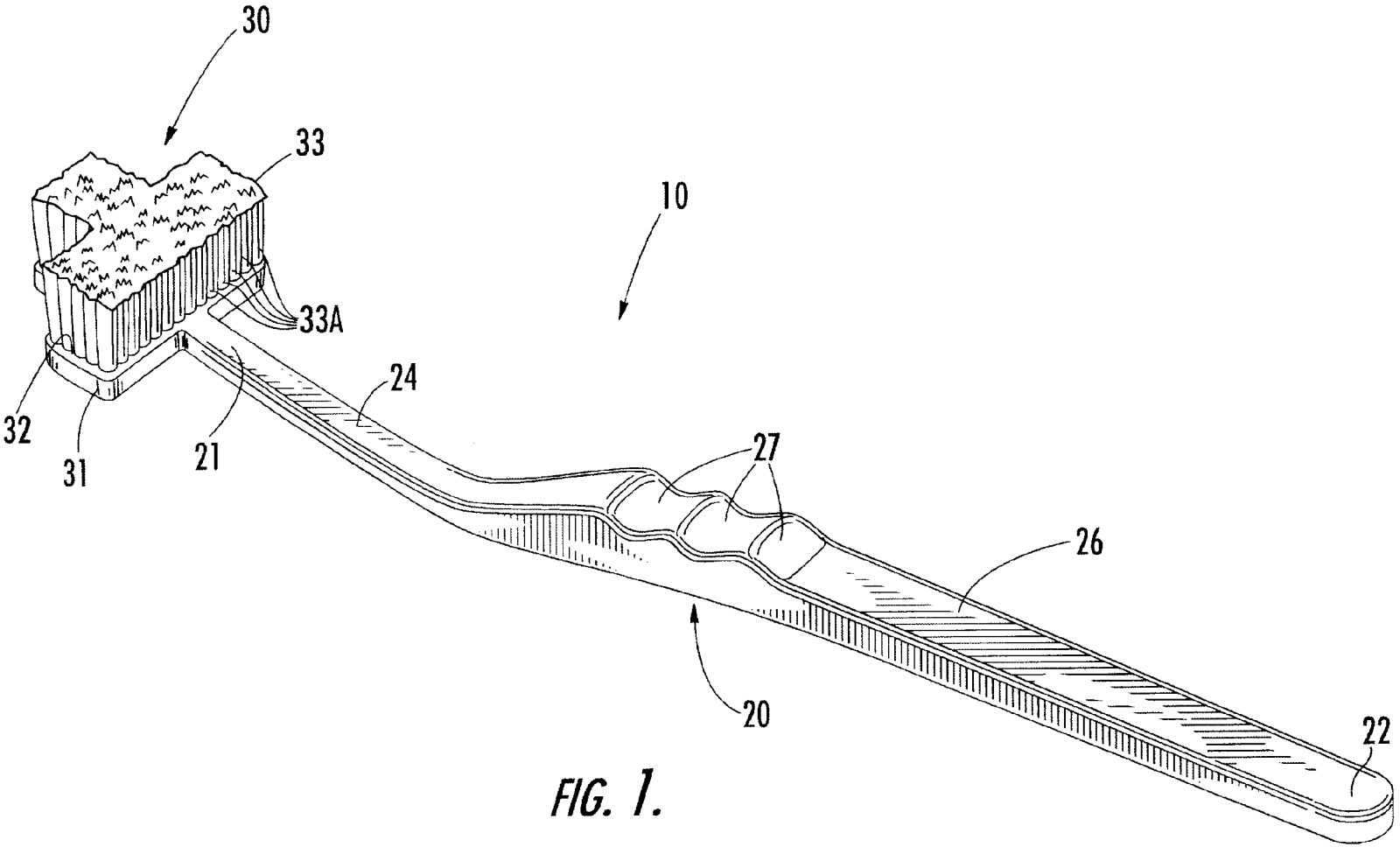
FIG. 1 is a perspective view of a toothbrush according to one preferred embodiment of the invention.

Referring now specifically to the drawings, a toothbrush according to the present invention is illustrated in FIG. 1 and shown generally at reference numeral 10. The toothbrush 10 includes a handle 20 having proximal and distal ends 21 and 22, respectively. Although the handle 20 may be formed in any suitable shape and have any dimensions, the handle 20 is preferably elongate and is bent approximately midway between the proximal and distal ends 21 and 22, respectively, to form a neck portion 24 and a grip portion 26. A plurality of concave indentations 27 are formed in the handle 20 where the grip portion 26 and neck portion 24 meet for permitting the grip portion 26 to be easily grasped by a user's fingers. A head 30 is carried on the proximal end of the handle 20. The head includes a base 31 having an upper surface 32 to which multiple, upstanding bristles 33 are attached.

Figure 2:
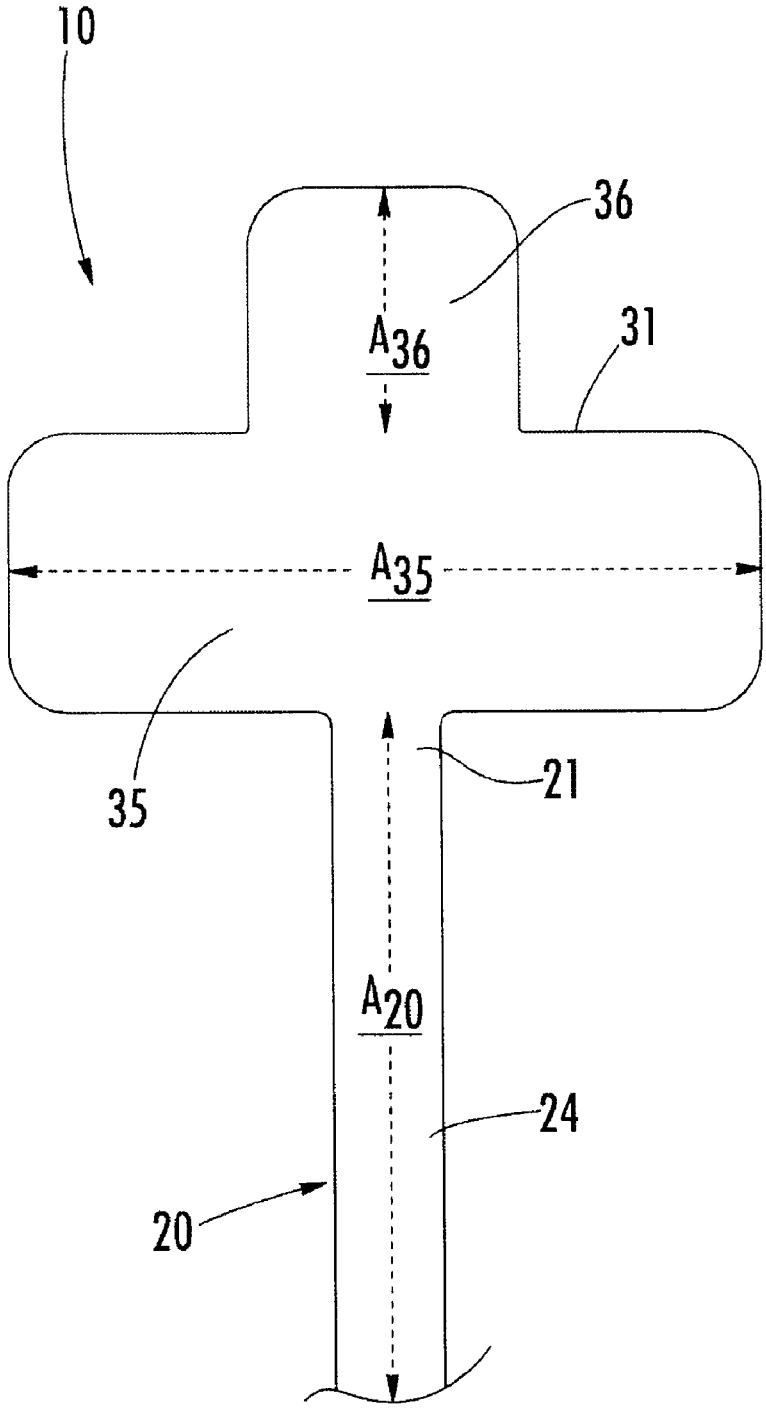
FIG. 2 is a partial top plan view of the head of the toothbrush shown in FIG. 1 with its bristles removed.

Referring now to FIG. 2, the toothbrush 10 is shown with the bristles 33 removed to reveal the underlying shape of the base 31. The base 31 is formed by first and second head members 35 and 36, respectively. First and second head members 35 and 36 may have any shape; however, the first and second head members 35 and 35 are each preferably rectangular. First head member 35 has a longitudinal axis "$A_{35}$", and is connected to the proximal end 21 so that the longitudinal axis "$A_{35}$"is positioned perpendicularly to the longitudinal axis "$A_{20}$" of the handle 20. Second head member 36 has a longitudinal axis "$A_{36}$", and is connected to and diverges with the first head member 35 so that the longitudinal axis "$A_{36}$," is in axial alignment with the longitudinal axis "$A_{20}$" of the handle 20. The first and second head members 35 and 36, the base 31 and the handle 20 are preferably molded together to form a single piece.

Referring again to FIG. 1, the bristles 33 cover the entire upper surface 32 of the base 31. The bristles 33 may be formed from any substance and attached to the upper surface 32 in any suitable manner. However, the bristles 33 are preferably grouped together into identical tufts 33A, which are positioned closely together and are then staked to the upper surface 32.

Figure 3:
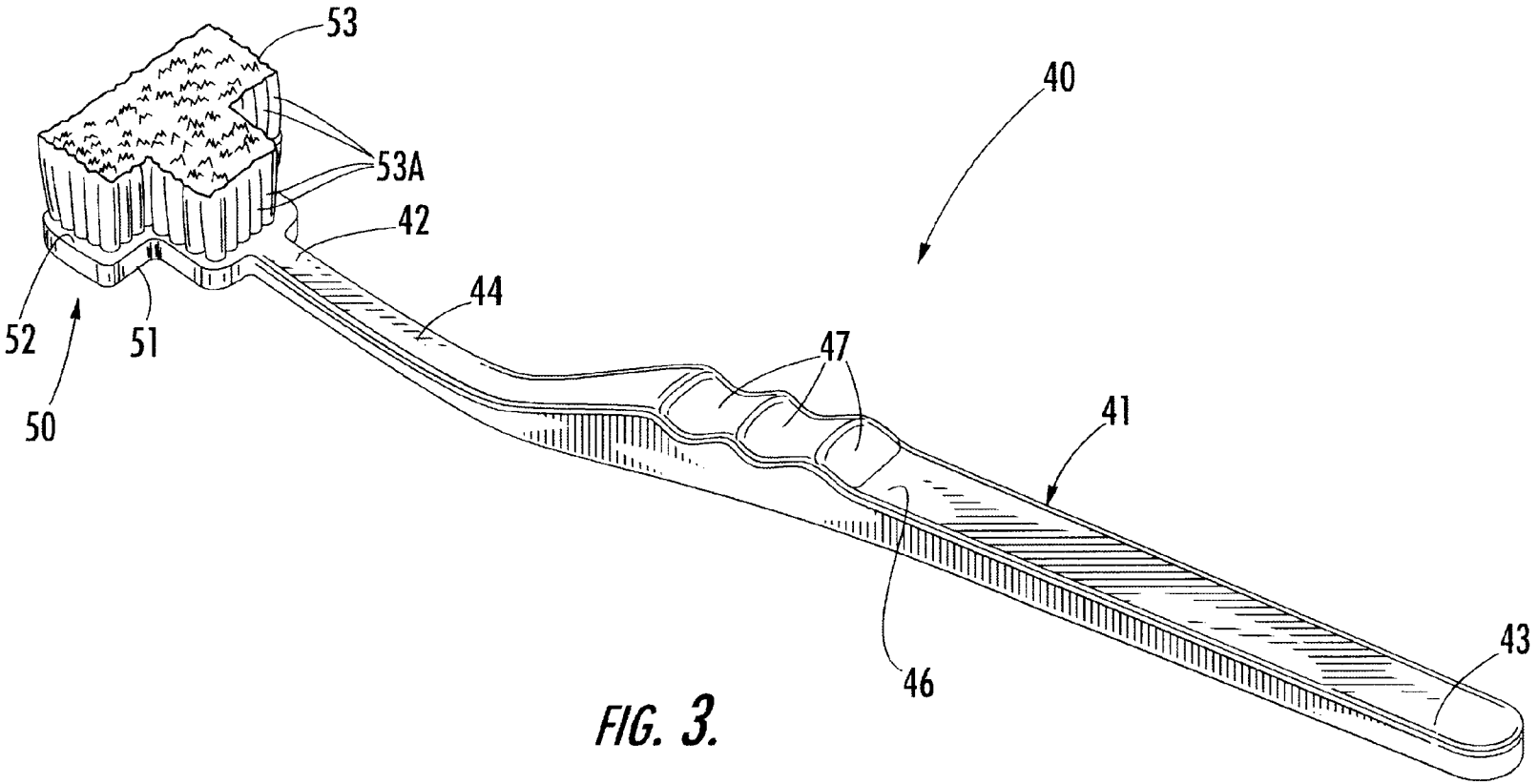
FIG. 3 is a perspective view of a toothbrush according to another preferred embodiment of the invention.

Referring now to FIG. 3, a toothbrush according to another embodiment of the invention is illustrated and shown generally at reference numeral 40. Like the toothbrush 10, toothbrush 40 includes a handle 41 having proximal and distal ends 42 and 43, respectively. Although the handle 41 may be formed in any suitable shape and have any suitable dimensions, the handle 41 is preferably elongate and includes a neck portion 44 which is integrally formed with a grip portion 46. Concave indentations 47 are formed in the grip portion 46 at the point where the grip portion 46 and neck portion 44 meet for making the handle 41 easier to grasp by the user.

Figure 4:
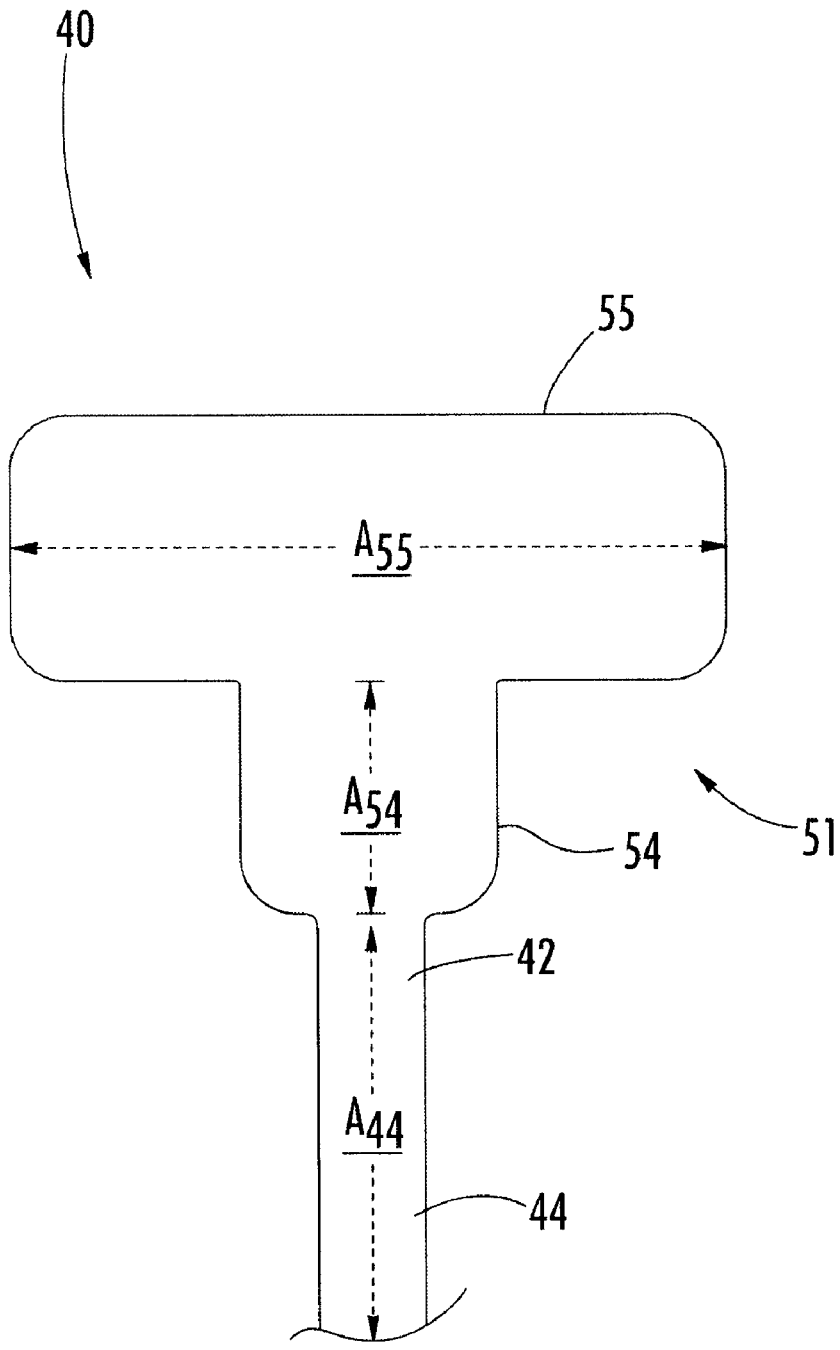
FIG. 4 is a partial top plan view of the head of the toothbrush shown in FIG. 3 with its bristles removed.

The toothbrush 40 includes a head 50, which is carried by the proximal end 42 of the handle 41. The head 50 includes a base 51 having an upper surface 52 to which multiple bristles 53 are attached. As is shown in FIG. 4, the base 51 is formed from first and second head members 54 and 55, respectively. First and second head members 54 and 55 each preferably have a rectangular shape and include respective longitudinal axes "$A_{54}$" and "$A_{55}$". The first head member 54 is integrally formed with proximal end 42 so that its longitudinal axis "$A_{54}$" is aligned with the longitudinal axis "$A_{41}$" of the handle 41. Second head member 55 is integrally formed with the first head member 54, and is positioned so that its longitudinal axis "$A_{55}$" is perpendicular to the longitudinal axis "$A_{54}$" of the first head member 54. Like the toothbrush 10, the first and second head members 54 and 55, the base 51 and the handle 41 are molded together to form a single piece.

Referring again to FIG. 3, while the bristles 53 may be attached to the head 50 in any suitable manner, the bristles 53 are preferably grouped together into identical tufts 53A, and staked closely together on the upper surface 52 to cover the first and second head members 54 and 55.

Figure 5:
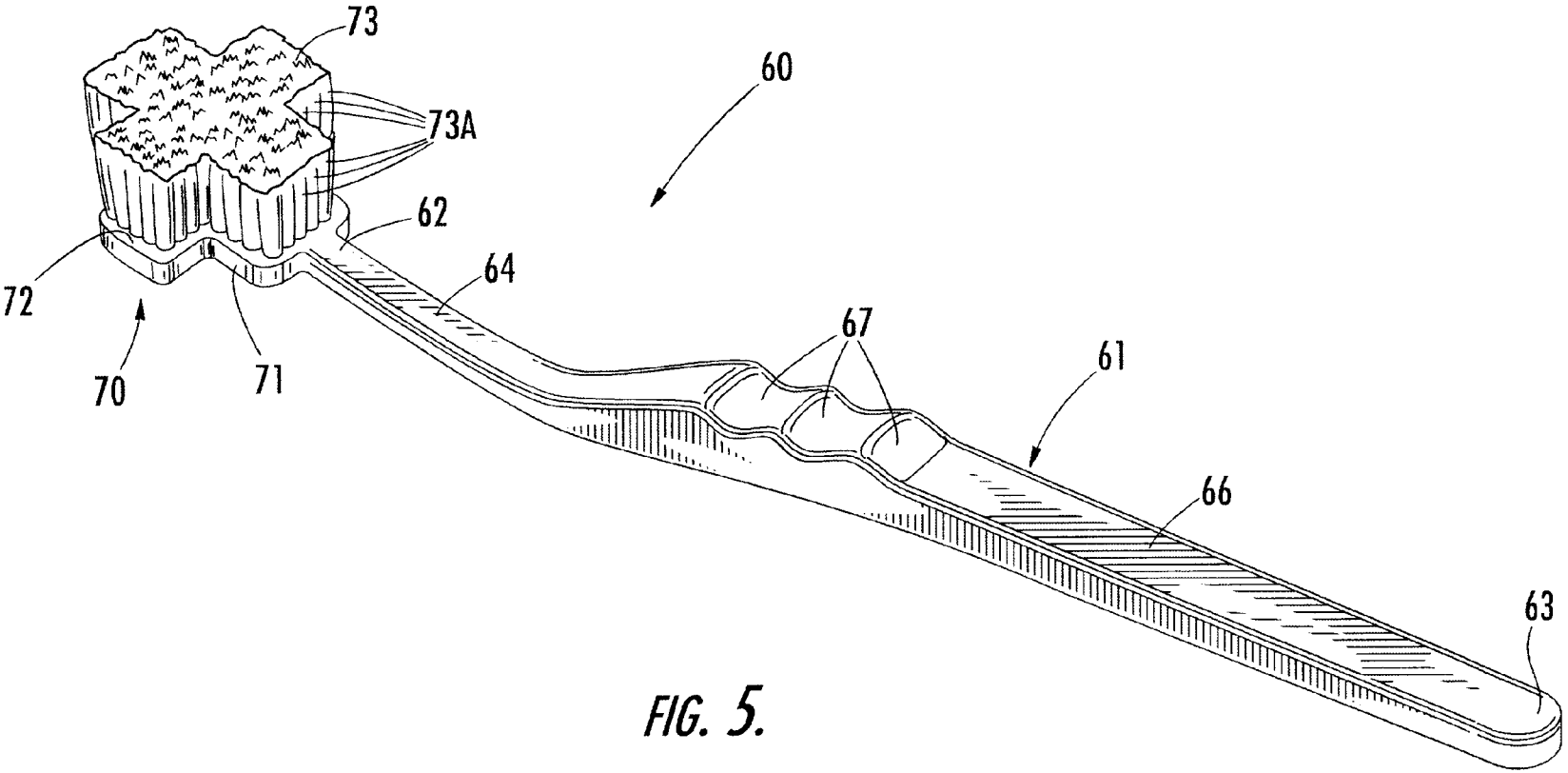
FIG. 5 is a perspective view of a toothbrush according to another preferred embodiment of the invention.

Referring now to FIG. 5, a toothbrush according to an alternative embodiment of the invention is illustrated and shown generally at reference numeral 60. The toothbrush includes a handle 61, which is identical to the handle of toothbrushes 10 and 40. The handle 61 has a proximal end 62 and a distal end 63. Although the handle 61 may have any shape and dimensions, the handle 61 is preferably elongate and includes a neck portion 64 which is integrally formed with, and narrower than, a grip portion 66. The grip portion 66 includes a plurality of concave indentations 67 which are for making the handle 60 easier to grasp.

The toothbrush 50 also includes a head 70, which is integrally formed with the proximal end 62 of the handle 61. The head 70 has a base 71 which includes an upper surface 72 to which multiple bristles 73 are attached. The bristles 73 may be formed from any suitable substance, and preferably cover the entire upper surface 72. Although the bristles 73 may be attached to the head in any suitable manner, the bristles 73 are preferably grouped together to form identical tufts 73A. The tufts 73A are positioned closely together on and staked to the upper surface 72.

Figure 6:
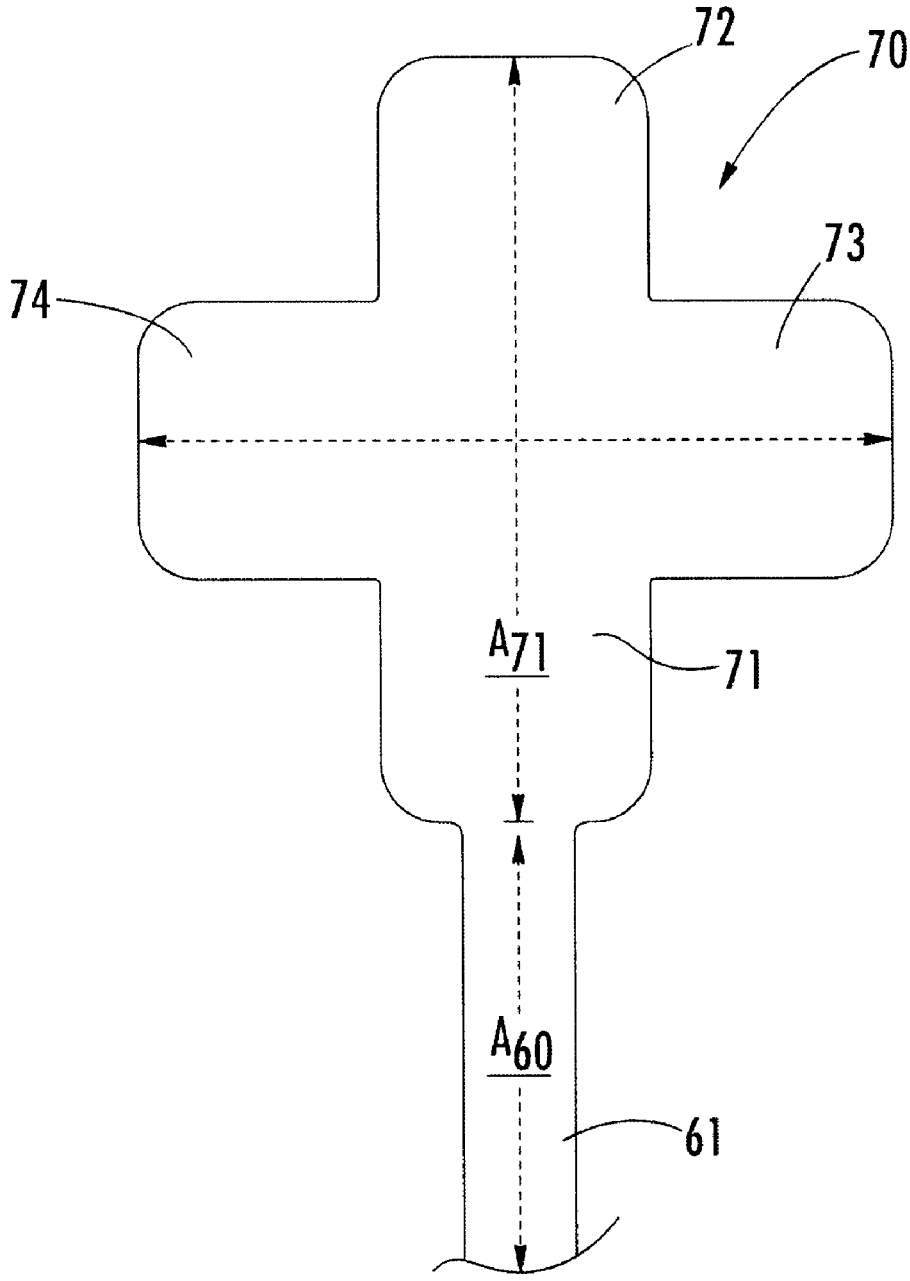
FIG. 6 is a partial top plan view of the head of the toothbrush shown in FIG. 5 with its bristles removed.

Referring now to FIG. 6, the underlying shape of the head 70 is shown. The head 70 is integrally formed from first, second, third and fourth head segments 71, 72, 73, and 74 respectively. First and second head segments 71 and 72 are positioned opposite one another and extend along the same axis "$A_{71}$", which is in alignment with the longitudinal axis "$A_{61}$" of the handle 61. Third and fourth head segments 73 and 74 are positioned perpendicular to the handle 61, and first and second head segments 71 and 72 to form a cross-shaped head 70. This unique cross shape increases the surface area available for cleansing the teeth and orthodontic appliances during brushing.

Figure 7:
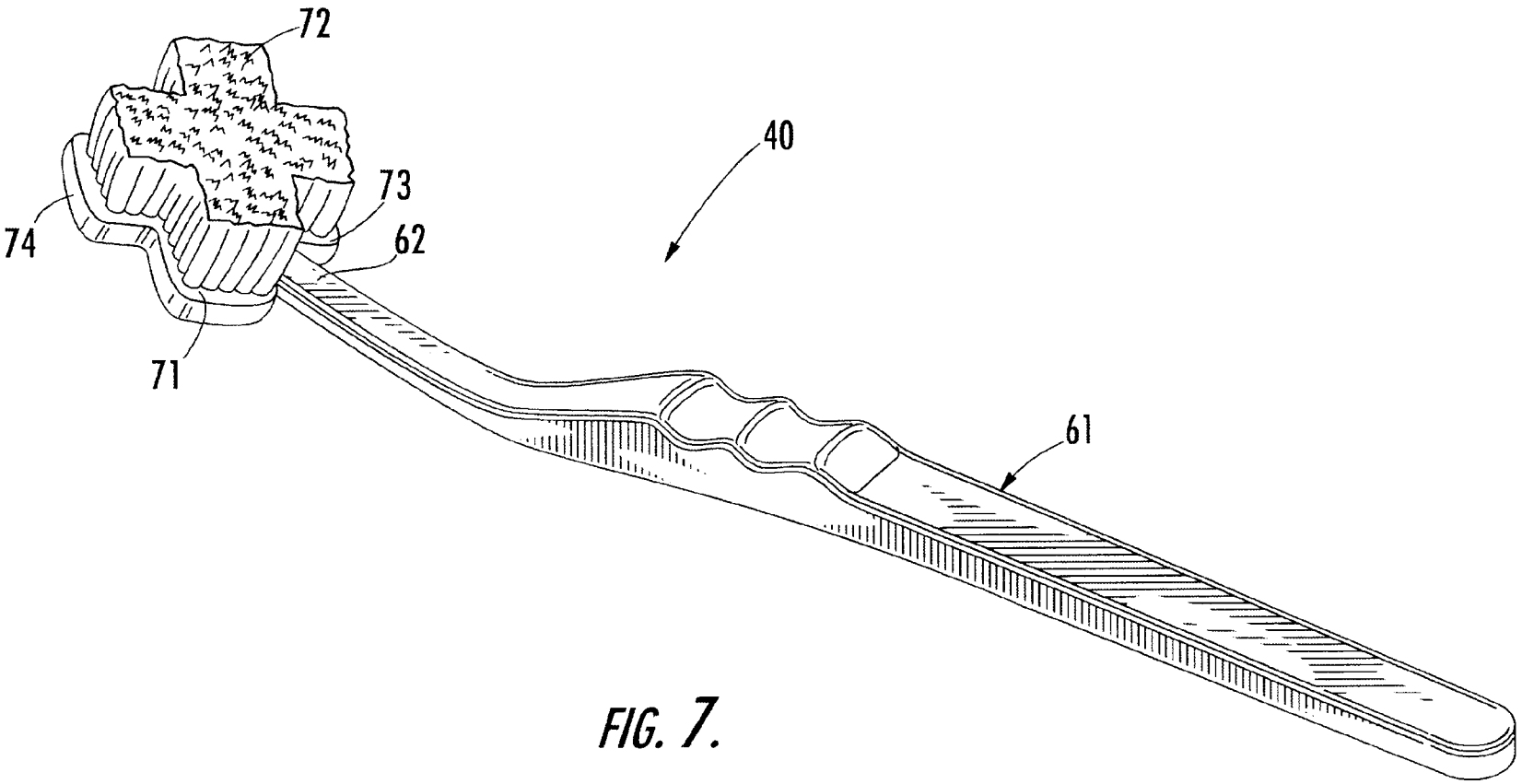
FIG. 7 is a perspective view of a toothbrush according to another preferred embodiment of the invention.

FIG. 6 shows the first head segment 71 connected to the proximal end 62; however, any one of the second, third or fourth head segments 72, 73, or 74, respectively, may alternatively be connected to the proximal end 62. The head 70 may also be alternatively attached to the proximal end 62 of the handle 61 at any one of the points at which the head segments 71, 72, 73, or 74 diverge with one another. FIG. 7 shows the head 70 attached to the proximal end 61 at the point at which the first head segment 71 and third head segment 73 diverge.

Figure 8:
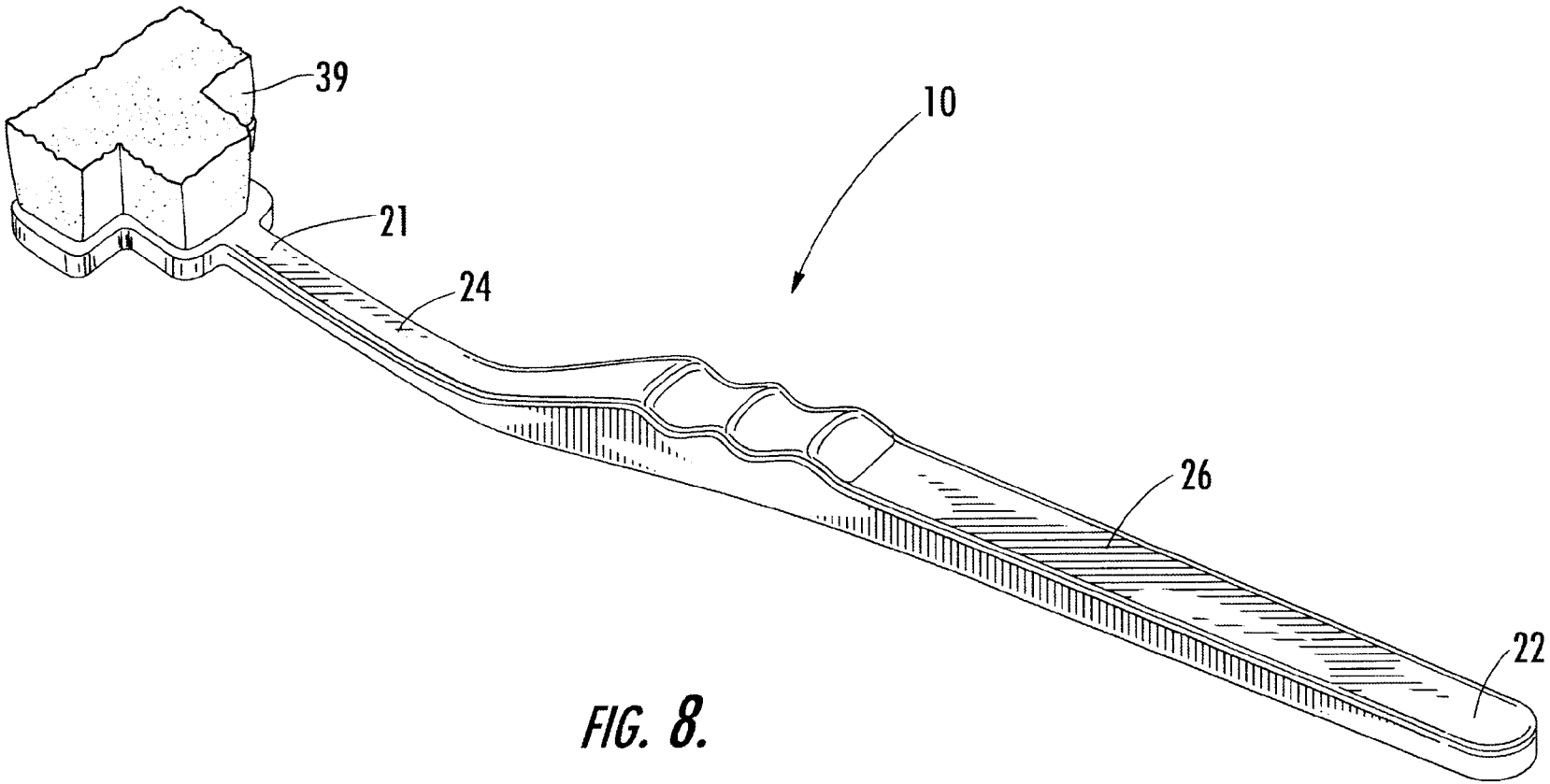
FIG. 8 is a perspective view of a toothbrush according to another preferred embodiment of the invention.

Referring now to FIG. 8, an alternative brushing surface is shown which may be used in place of the bristles 31, 53 or 73 on any one of the toothbrushes 10, 40 or 60. Using toothbrush 10 as a representative example, the upper surface 31 of the head 30 may alternatively include a brushing surface 39 formed from a flexible pad of coarse felt or any other suitable synthetic material having a toothed surface 39A, which easily moves around and along the surfaces of the teeth and orthodontic appliances.

A toothbrush for cleansing the teeth and any orthodontic appliances positioned thereon is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A toothbrush for cleansing the surfaces of the teeth and any orthodontic appliances positioned thereon, comprising:

(a) a unitary body, including:

(i) an elongate handle including a grip portion having concave indentations formed on a surface thereof for permitting a user to grasp said handle, and a neck portion integrally formed with said grip portion and positioned at an obtuse angle thereto;

(ii) a cross-shaped head integrally formed with one end of the neck portion and including a first head member positioned in axial alignment with the longitudinal axis of said handle and a second head member integrally formed with said first head member and having a longitudinal axis positioned perpendicular to the longitudinal axis thereof, wherein each of said head members includes a preselected transaxial width, and rounded corners defined by respective curves having combined radii of at least seventy-five percent of the transaxial width of the head member for permitting ease of movement of the head member past the irregularities of the user's mouth and the outwardly-extending orthodontic appliances; and (b) a multiplicity of upright bristles attached to both head members and extending outwardly therefrom for defining an enlarged cleaning surface area sufficient to simultaneously engage the upper and lower teeth during brushing.

2. A toothbrush according to claim 1, wherein said neck and grip portions each include a preselected width transaxial to the longitudinal axis of the handle, the transaxial width of the neck portion being less than the transaxial width of the grip portion.

3. A toothbrush according to claim 1, wherein the first and second head members define at least three distinct and diverging head segments, whereby two of said head segments are positioned opposite each other and extend along a common axis, and another of the head segments is positioned perpendicular thereto.

4. A toothbrush according to claim 1, wherein the first and second head members define four head segments, whereby two of said head segments are positioned opposite each other and extend along a common axis, and the other two head segments are positioned perpendicular thereto.

5. A toothbrush according to claim 3 or 4, wherein said first and second head members are positioned perpendicular to each other and are carried by said handle at point at which any two of the head segments diverge.

6. A toothbrush according to claim 1, wherein said first and second head members collectively define a first planar face to which said bristles are attached.

7. A toothbrush according to claim 1, wherein said bristles are grouped to form a multiplicity of tufts positioned in spaced-apart relation to one another and staked to the head segments.

8. A toothbrush according to claim 7, wherein said first and second head members collectively define a first planar face to which said tufts are attached.

9. A toothbrush according to claim 6 or 8, wherein the first and second head members collectively define a second planar face positioned in spaced-apart, opposing relation to said first planar face and interconnected therewith by a sidewall, thereby forming said cross-shaped head.

10. A toothbrush according to claim 1, wherein said head is positioned at an obtuse angle to the neck portion.

11. A toothbrush according to claim 1, wherein said cleaning elements comprise coarse felt.

* * * * *